US007077343B2

(12) United States Patent
Lemanowicz et al.

(10) Patent No.: US 7,077,343 B2
(45) Date of Patent: Jul. 18, 2006

(54) SUBMERGED NOZZLE FOR A METALLURGIC CONTAINER PLACED UPSTREAM FROM A CASTING DEVICE

(75) Inventors: Ina Lemanowicz, Neukirchen-Vluyn (DE); Hans Streubel, Erkrath (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/501,248

(22) PCT Filed: Jan. 22, 2003

(86) PCT No.: PCT/DE03/00186

§ 371 (c)(1),
(2), (4) Date: Jul. 7, 2004

(87) PCT Pub. No.: WO03/061880

PCT Pub. Date: Jul. 31, 2003

(65) Prior Publication Data

US 2005/0082399 A1 Apr. 21, 2005

(30) Foreign Application Priority Data

Jan. 23, 2002 (DE) ..... 102 03 594

(51) Int. Cl.
*B05B 1/00* (2006.01)

(52) U.S. Cl. ..... 239/597; 239/595; 239/592; 239/599; 239/601; 222/606

(58) Field of Classification Search ..... 239/592, 239/594, 595, 597, 524, 518, 599, 601; 222/606, 222/607, 594
See application file for complete search history.

(56) References Cited

U.S. PATENT DOCUMENTS

| | | | | |
|---|---|---|---|---|
| 1,033,195 | A * | 7/1912 | Robinson | 239/592 |
| 1,133,711 | A * | 3/1915 | Cornelius | 239/591 |
| 1,599,411 | A * | 9/1926 | Gilsenan | 239/595 |
| 5,205,343 | A | 4/1993 | Streubel et al. | |
| 5,402,993 | A | 4/1995 | Hofmann et al. | |
| 5,681,498 | A | 10/1997 | Poloni et al. | |
| 5,944,261 | A * | 8/1999 | Heaslip et al. | 239/553.5 |
| 5,961,874 | A * | 10/1999 | Hasebe et al. | 222/606 |
| 6,152,336 | A | 11/2000 | Arvedi et al. | |
| 6,336,575 | B1 | 1/2002 | Schemeit et al. | |
| 6,467,704 | B1 * | 10/2002 | Sahai et al. | 239/553.5 |

FOREIGN PATENT DOCUMENTS

| | | |
|---|---|---|
| DE | 41 42 447 A1 | 12/1992 |
| DE | 197 15 826 | 10/1998 |
| EP | 0 403 808 | 12/1990 |

(Continued)

*Primary Examiner*—Dinh Q. Nguyen
(74) *Attorney, Agent, or Firm*—Cohen, Pontani, Lieberman & Pavane

(57) ABSTRACT

The invention is directed to an immersion nozzle for a metallurgic vessel arranged upstream of a casting device, in particular a continuous casting mold or a twin roller, in which a slit-shaped pour-out opening (2) having a length that is several times greater than its width is provided in the base area. The cross section widens in the direction of its mouth from a round inlet cross section to a mouth cross section whose one semiaxis is smaller than, and whose other semi-axis extending perpendicular thereto is greater than, the semiaxis of the round inlet cross section and whose base shape corresponds to that of the body of revolution of an ellipse or of an oval mouth cross section around the greater semiaxis, and the slit-shaped outlet opening extends in direction of the greater semiaxis.

9 Claims, 1 Drawing Sheet

FOREIGN PATENT DOCUMENTS

| | | |
|---|---|---|
| EP | 0 482 423 A1 | 4/1992 |
| EP | 0 709 153 | 5/1996 |

* cited by examiner

SUBMERGED NOZZLE FOR A METALLURGIC CONTAINER PLACED UPSTREAM FROM A CASTING DEVICE

CROSS REFERENCE TO RELATED APPLICATIONS

This is a U.S. national stage application under 35 U.S.C. 0371 of international stage application No. PCT/DE03/00186, filed on 22 Jan. 2003. Priority is claimed under 35 U.S.C. §119(a) and 35 U.S.C. §365(b) from German Patent Application No. 102 03 594.6 which was filed on 23 Jan. 2002, and from which priority was properly claimed in the aforementioned international stage application.

FIELD OF INVENTION

The invention is directed to an immersion nozzle for a metallurgic vessel arranged upstream of a casting device in which a slit-shaped pour-out opening having a length that is several times greater than its width is provided in the mouth area.

By casting device it is meant, for example, a continuous casting mold or a strip casting installation such as a twin roller.

BACKGROUND OF THE INVENTION

An immersion nozzle of the type mentioned above is known from WO 98/53938. This immersion nozzle has a cylindrical shape with a circular, oval or bone-shaped cross section. The outlet opening is slit-shaped and extends continuously at the base and into the side wall of the cylindrical part of the immersion nozzle. With this construction of the immersion nozzle, a long useful life is achieved, as is guidance of the molten metal with little turbulence and a small penetration depth into the slab mold.

It is disadvantageous that the flow back to the casting surface is small in an immersion nozzle of this kind with slab widths above 1200 mm. This negatively affects casting slag formation because there is too little heat entering the casting surface due to insufficient flow and, therefore, inadequate supply of new hot molten metal into this area.

SUMMARY OF THE INVENTION

Therefore, it is an object of the invention to improve the immersion nozzle of the type mentioned above in such a way that there is an improvement in the flow profile even with larger slab widths.

DETAILED DESCRIPTION OF THE PREFERRED EMBODIMENTS

Figure 1:
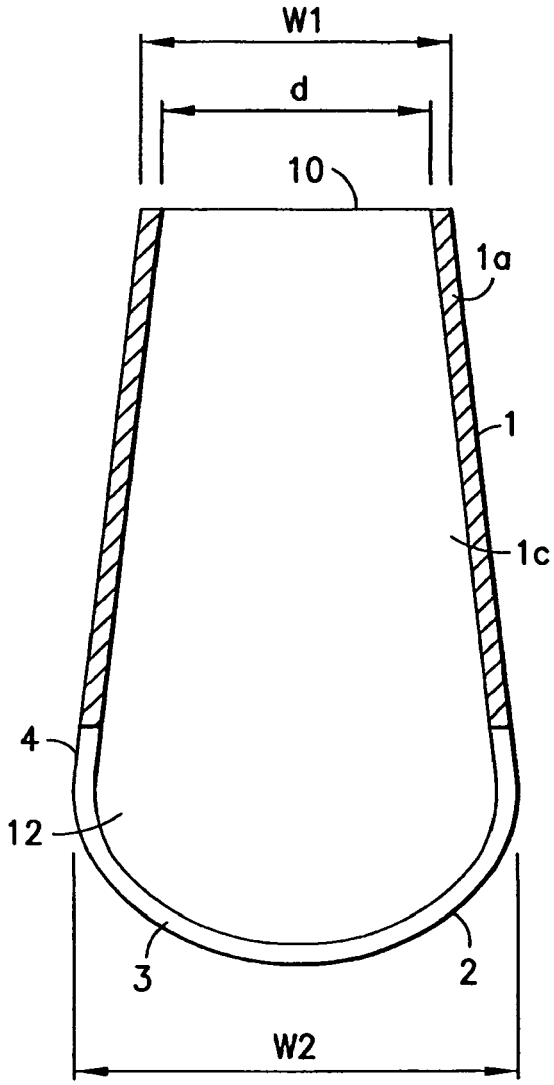
FIG. 1 is a cross sectional view of an immersion nozzle in accordance with the teachings of the present invention.

In an immersion nozzle for a metallurgic vessel arranged upstream of a casting device in which a slit-shaped pour-out opening having a length that is several times greater than its width is provided in the mouth area, the above-stated object is met, in that its cross section widens in the direction of its mouth from a round inlet cross section to a mouth cross section whose one or first semiaxis is smaller than, and whose other or second semiaxis extending perpendicular thereto is greater than, the semiaxis of the round or circular inlet cross section and whose bottom shape or base shape corresponds to that of the body of revolution of an ellipse or of an oval mouth cross section around the greater semiaxis, and in that the slit-shaped outlet opening extends in direction of the greater semiaxis.

The mouth cross section can have the shape of an ellipse or rhombus, for example; but it is also possible for the mouth cross section to have a shape combining a round cross section and an ellipse-like cross section. The base of the mouth cross section preferably extends in an arc-shaped manner direction of the smaller semiaxis or, alternatively, in direction of the greater semiaxis.

The transition from the circular cross section to the widened cross section of the immersion nozzle can be formed as a function of the first or nth degree.

The slit-shaped pour-out opening preferably extends over the length of the entire base area. It can also extend in the side wall.

The shape of the slit-shaped pour-out opening can correspond to that of a rectangle.

According to another development, the width of the pour-out opening can increase outward from the center.

The funnel-shaped widening of an immersion nozzle, as such, is known per se. However, in the prior art the round inlet cross section changes to a slit-shaped mouth cross section, i.e., to a cross section whose length is substantially greater than its width. The entire mouth cross section therefore resembles the rectangular shape of the slab mold (DE 41 42 447).

The inventive funnel-shaped widening of the immersion nozzle from a round cross-sectional shape to, e.g., an elliptic mouth cross section ch outside the immersion nozzle so that there is a widening of the flow in the casting direction and a stronger back-flow outside the immersion nozzle which, as a result of a greater heat input, leads in turn to an improved melting of the casting powder located on the surface of the melt.

The flow conditions are also substantially influenced by the base shape, specifically the inner shape and the outer shape, assuming in the present description that the inner base shape and outer base shape are substantially identical.

An embodiment example of the immersion nozzle according to the invention is shown in the drawing, specifically, in longitudinal cross section and in a side view.

As can be seen from FIG. 1, which shows a longitudinal cross section, the cross section of the immersion nozzle 1 widens in the casting direction (arrow) from the round cross section to an elliptic cross section, wherein the funnel shape is formed in such a way that the extension of the smaller semiaxis of the ellipsoid is less than that of the one (corresponding) axis of the round upper inlet cross section.

Figure 2:
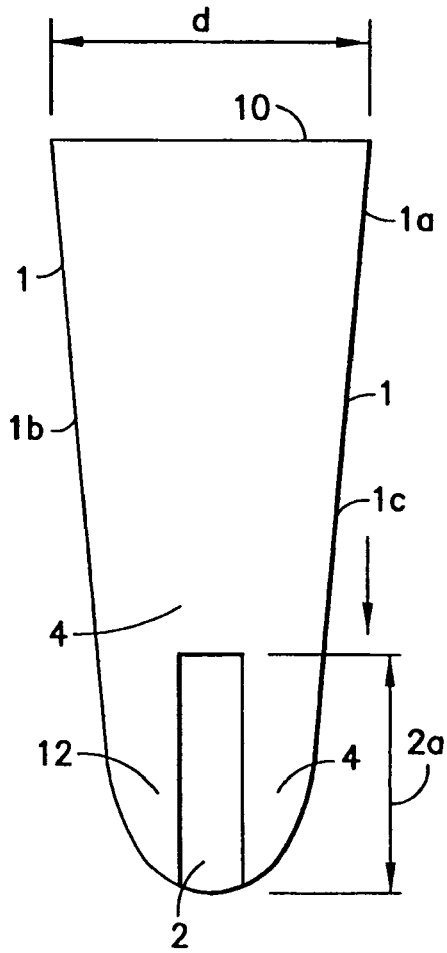
FIG. 2 is a side view of an immersion nozzle in accordance with the teachings of the present invention.

In the construction shown in FIG. 1 and FIG. 2, the slit-shaped pour-out opening 2 extends along the entire base area 3 into the side wall 4.

The preferred embodiment as shown in FIGS. 1 and 2 is discussed further below. The immersion nozzle 1 is for a metallurigical casting device and it acts as a guide for molten metal (not shown) passing through the nozzle. The immersion nozzle 1 has a round cross section 10 at a one or inlet end 1*a* of the immersion nozzle 1 and the round cross section 10 has a diameter d oriented along a first axis. The slit shaped pour out opening 2, which forms an elliptical mouth opening, is located at the base area 3 of the other or outlet end 12 of the immersion nozzle 1. The immersion nozzle 1 has a front section 1*c* with an increasing width (compare W1 to W2) towards the outlet end 12 and a back section 1*b* with an increasing width towards the outlet end 12. As seen in FIG. 2, the immersion nozzle has side wall sections 4 connecting the front section 1*c* to the back section 1*b*. The elliptical mouth opening 2 spans the width of the front section at the base area (see W2) and further extends into the side wall sections (see 2*a*). The elliptical mouth opening 2 shape may widen a flow of the molten metal and create a backflow outside the immersion nozzle which provides improved melting of casting powder located on the surface of a melt.

What is claimed is:

1. An immersion nozzle for a metallurgic vessel comprising:

an inlet end; and an outlet end having a base area, and a slit-shaped pour-out opening in the base area, the slit-shaped pour-out opening having a length several times greater than its width, wherein the immersion nozzle has a cross section that widens, in a direction of the outlet end, from a round inlet cross section having a semiaxis at the inlet end to a mouth cross section at the outlet end, the mouth cross section having a shape of one of an ellipse, a rhombus, and a combination of a circle and an ellipse, the mouth cross section further having a first semiaxis smaller than the semiaxis of the round inlet cross section, and a second semiaxis perpendicular to the first semiaxis, the second semiaxis being greater than the semiaxis of the round inlet cross section, and wherein from the mouth cross section to the base area the immersion nozzle has a shape corresponding to that of a body of revolution of an ellipse or of an oval cross section around the second semiaxis, and the slit-shaped outlet opening extends along the second semiaxis.

2. The immersion nozzle of claim 1, wherein the base area extends in an arc-shaped manner in a direction of the first semiaxis.

3. The immersion nozzle of claim 1, wherein the base area extends in an arc-shaped manner in a direction of the second semiaxis.

4. The immersion nozzle of claim 1, wherein the widening of the cross section from the round input cross section to the mouth cross section is formed as a function of a first degree.

5. The immersion nozzle of claim 1, wherein the widening of the cross section from the round input cross section to the mouth cross section is formed as a function of an nth degree.

6. The immersion nozzle of claim 1, wherein the slit-shaped pour-out opening extends over a length of the base area.

7. The immersion nozzle of claim 6, wherein the immersion nozzle further has a side wall, and the slit-shaped pour-out opening extends into the side wall.

8. The immersion nozzle of claim 1, wherein the slit-shaped pour-out opening has a shape of a rectangle.

9. The immersion nozzle of claim 1, wherein the slit-shaped pour-out opening has a center, and a width which increases outward from the center.

* * * * *